US006455750B1

(12) United States Patent
Steffens et al.

(10) Patent No.: US 6,455,750 B1
(45) **Date of Patent: *Sep. 24, 2002**

(54) PROCESS FOR SELECTIVELY PRODUCING LIGHT OLEFINS

(75) Inventors: Todd R. Steffens; Paul K. Ladwig, both of Randolph, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/437,408

(22) Filed: Nov. 10, 1999

Related U.S. Application Data

(63) Continuation-in-part of application No. 09/073,085, filed on May 5, 1998, now Pat. No. 6,069,287.

(51) Int. Cl.[7] ..... C07C 4/06

(52) U.S. Cl. ..... 585/648; 585/649; 585/650; 585/651; 585/653; 208/135; 208/120.01

(58) Field of Search ..... 585/648, 649, 585/650, 651, 653; 208/135, 120.01

(56) References Cited

U.S. PATENT DOCUMENTS

| | | | | | |
|---|---|---|---|---|---|
| 3,442,792 | A | | 5/1969 | Eng et al. | 208/62 |
| 3,533,937 | A | | 10/1970 | Stankis | 208/62 |
| 3,770,618 | A | | 11/1973 | Adams et al. | 208/216 |
| 3,801,494 | A | | 4/1974 | Moore et al. | 208/79 |
| 3,893,905 | A | * | 7/1975 | Fenske et al. | 208/103 |
| 3,899,543 | A | | 8/1975 | Cosyns et al. | 260/667 |
| 3,928,172 | A | | 12/1975 | Davis, Jr. et al. | 208/77 |
| 3,957,625 | A | | 5/1976 | Orkin | 208/211 |
| 3,959,116 | A | | 5/1976 | Arey, Jr. et al. | 208/66 |
| 4,171,257 | A | | 10/1979 | O'Rear et al. | 208/120 |
| 4,177,136 | A | | 12/1979 | Herrington et al. | 208/215 |
| 4,282,085 | A | | 8/1981 | O'Rear et al. | 208/120 |
| 4,502,945 | A | | 3/1985 | Olbrich et al. | 208/120 |
| 4,830,728 | A | | 5/1989 | Herbst et al. | 208/78 |
| 4,865,718 | A | | 9/1989 | Herbst et al. | 208/70 |
| 4,927,526 | A | * | 5/1990 | Anderson et al. | 208/152 |
| 4,950,387 | A | | 8/1990 | Harandi et al. | 208/49 |
| 4,975,179 | A | | 12/1990 | Harandi et al. | 208/66 |
| 5,026,935 | A | | 6/1991 | Leyshon et al. | 585/315 |
| 5,026,936 | A | | 6/1991 | Leyshon et al. | 585/315 |
| 5,041,208 | A | | 8/1991 | Patridge et al. | 208/138 |
| 5,043,522 | A | | 8/1991 | Leyshon et al. | 585/651 |
| 5,047,142 | A | | 9/1991 | Sherwood, Jr. et al. | 208/251 H |
| 5,069,776 | A | | 12/1991 | Biswas et al. | 208/120 |
| 5,094,994 | A | | 3/1992 | Sherwood, Jr. et al. | 502/314 |
| 5,143,596 | A | | 9/1992 | Maxwell et al. | 208/89 |
| 5,160,424 | A | | 11/1992 | Le et al. | 208/67 |
| 5,171,921 | A | | 12/1992 | Gaffney et al. | 585/653 |
| 5,286,373 | A | | 2/1994 | Sudhakar et al. | 208/216 |
| 5,292,976 | A | | 3/1994 | Dessau et al. | 585/322 |
| 5,346,609 | A | | 9/1994 | Fletcher et al. | 208/89 |
| 5,347,061 | A | | 9/1994 | Harandi et al. | 585/323 |
| 5,348,928 | A | | 9/1994 | Kukes et al. | 502/306 |
| 5,358,633 | A | | 10/1994 | Dai et al. | 208/216 R |
| 5,372,704 | A | | 12/1994 | Harandi et al. | 208/74 |
| 5,378,352 | A | | 1/1995 | Degnan et al. | 208/217 |
| 5,389,232 | A | | 2/1995 | Adewuyi et al. | 208/120 |
| 5,396,010 | A | | 3/1995 | Harandi et al. | 585/418 |
| 5,409,596 | A | | 4/1995 | Fletcher et al. | 208/89 |
| 5,414,172 | A | | 5/1995 | Chin et al. | 585/322 |
| 5,468,372 | A | | 11/1995 | Seamans et al. | 208/216 R |
| 5,472,594 | A | | 12/1995 | Tsang et al. | 208/114 |
| 5,525,211 | A | | 6/1996 | Sudhakar et al. | 208/217 |
| 5,576,256 | A | | 11/1996 | Monque et al. | 502/61 |
| 5,591,324 | A | | 1/1997 | Monque et al. | 208/216 R |
| 5,643,441 | A | | 7/1997 | Timken et al. | 208/89 |
| 5,770,047 | A | | 6/1998 | Salazar et al. | 208/254 R |
| 5,865,987 | A | | 2/1999 | Borghard et al. | 208/97 |
| 5,865,988 | A | | 2/1999 | Collins et al. | 208/97 |
| 5,951,963 | A | | 9/1999 | He et al. | 423/713 |
| 5,985,136 | A | | 11/1999 | Brignac et al. | 208/216 R |
| 6,069,287 | A | * | 5/2000 | Ladwig et al. | 585/648 |
| 6,093,867 | A | * | 7/2000 | Ladwig et al. | 585/648 |
| 6,106,697 | A | * | 8/2000 | Swan et al. | 208/77 |
| 6,126,812 | A | | 10/2000 | Drake et al. | 208/134 |
| 6,126,814 | A | | 10/2000 | Lapinski et al. | 208/217 |

FOREIGN PATENT DOCUMENTS

| | | | | |
|---|---|---|---|---|
| EP | 0022883 | A1 | 1/1981 | C10G/69/04 |
| EP | 0093475 | A1 | 4/1982 | C10G/35/06 |
| EP | 0109060 | A1 | 5/1984 | C07C/11/06 |
| EP | 0235416 | A1 | 9/1987 | C10G/35/095 |
| EP | 0420326 | A1 | 4/1991 | C10G/35/095 |
| EP | 0557527 | A1 | 9/1993 | C10G/35/095 |
| EP | 0347003 | B1 | 5/1996 | C10G/11/05 |
| EP | 0921179 | A1 | 6/1999 | C10G/11/05 |
| EP | 0921181 | A1 | 6/1999 | C10G/11/05 |
| WO | WO98/56874 | | 12/1998 | C10G/11/00 |
| WO | WO 01/04237 | | 1/2001 | C10G/11/00 |

OTHER PUBLICATIONS von Ballmoos et al., *Three–Dimensional Mapping of the Zoned Aluminum Distribution in ZSM–5*, Proceedings of the Sixth International Zeolite Conference, Reno, NV, Jul. 10–15, 1983, published by Butterworths & Co., Guilford, Engl., pp. 803–811, (1984) –no month.

*Journal of Catalysis*, vol. 71, pp. 447–448, (1981) –no month.

Derouane et al., *Applied Catalysis*, vol. 1, pp. 201–224, (1981) –no month.

Jacobs et al., *J. Phys. Chem.*, vol. 86, pp. 3050–3052 (1982) –no month.

Fleisch et al., *Journal of Catalysis*, vol. 99, pp. 117–125 (1986) –no month.

Meyers et al., *Journal of Catalysis*, vol. 110, pp. 82–95 (1988) –no month.

Gross et al., *Surface composition of dealuminated Y zeolites studied by X–ray photoelectron spectroscopy* (Mar. 8, 1983).

Kung, *Stud. Surf. Sci. Catal.*, vol. 122, pp. 23–33, (1999) –no month.

* cited by examiner

*Primary Examiner*—Nadine Preisch
(74) *Attorney, Agent, or Firm*—Gerrard J. Hughes

(57) ABSTRACT

The invention is related to a catalyst and a process for selectively producing light (i.e., $C_2$–$C_4$) olefins from a catalytically cracked or thermally cracked naphtha stream. The naphtha stream is contacted with a catalyst containing from about 10 to 50 wt. % of a crystalline zeolite having an average pore diameter less than about 0.7 nanometers at reaction conditions. The catalysts do not require steam activation.

6 Claims, 3 Drawing Sheets

Figure 1-A
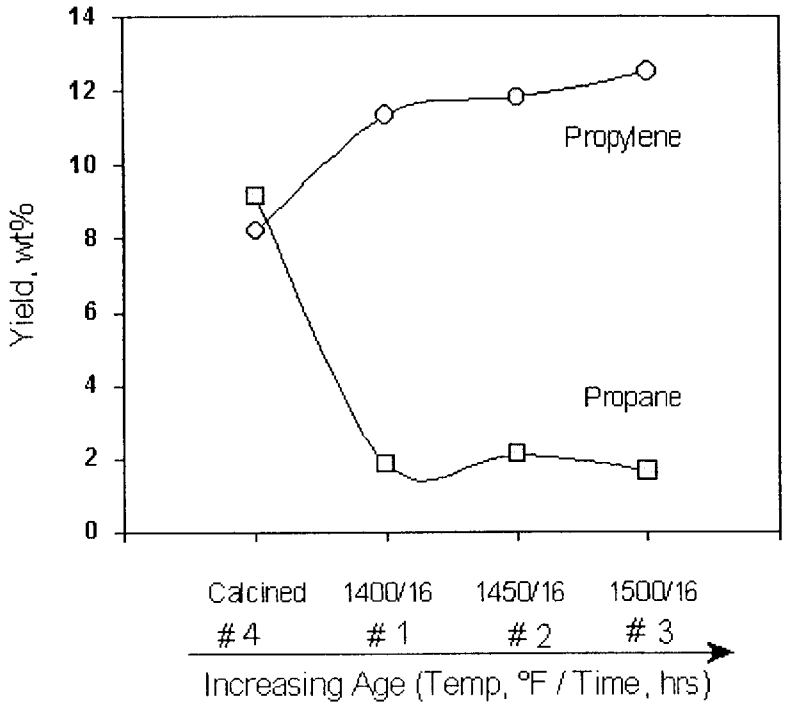
Figure 1-B
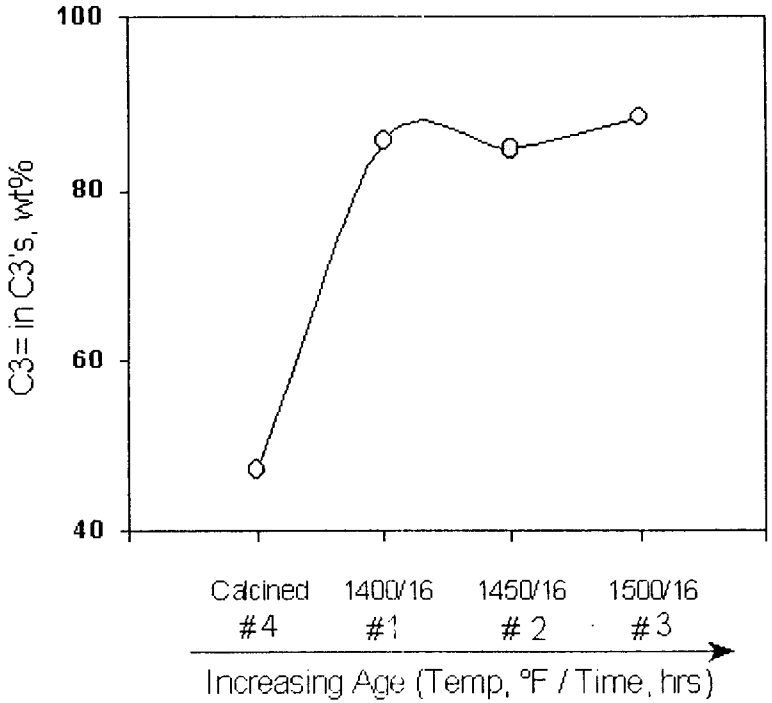

PROCESS FOR SELECTIVELY PRODUCING LIGHT OLEFINS

CROSS-REFERENCE TO RELATED APPLICATION

This is a continuation-in-part of U.S. Ser. No. 09/073,085 filed May 5, 1998 now U.S. Pat. No. 6,069,287.

BACKGROUND OF THE DISCLOSURE

FIELD OF THE INVENTION

The present invention relates to a process for catalytically converting a naphtha containing olefin in a process using a shape selective catalyst that does not require steaming to provide activity and selectively. More particularly, the invention relates to the use of such catalysts for producing light (i.e., $C_2$–$C_4$) olefins from a naphtha, and preferably from a catalytically cracked or thermally cracked naphtha stream. The naphtha stream is contacted with a catalyst containing from about 10 to 50 wt. % of a crystalline zeolite having an average pore diameter less than about 0.7 nanometers at reaction conditions which include temperatures from about 500° C. to about 650° C. and a hydrocarbon partial pressure from about 10 to 40 psia.

BACKGROUND OF THE INVENTION

The need for low emissions fuels has created an increased demand for light olefins for use in alkylation, oligomerization, MTBE and ETBE synthesis processes. In addition, a low cost supply of light olefins, particularly propylene, continues to be in demand to serve as feedstock for polyolefin, particularly polypropylene, production.

Fixed bed processes for light paraffin dehydrogenation have recently attracted renewed interest for increasing light olefin production. However, these types of processes typically require relatively large capital investments as well as high operating costs. It is, therefore, advantageous to increase light olefin yield using processes which require relatively small capital investment. It would be particularly advantageous to increase light olefin yield in catalytic cracking processes.

U.S. Pat. No. 4,830,728 discloses a fluid catalytic cracking (FCC) unit that is operated to maximize light olefin production. The FCC unit has two separate risers into which a different feed stream is introduced. The operation of the risers is designed so that a suitable catalyst will act to convert a heavy gas oil in one riser and another suitable catalyst will act to crack a lighter olefin/naphtha feed in the other riser. Conditions within the heavy gas oil riser can be modified to maximize either gasoline or light olefin production. The primary means of maximizing production of the desired product is by using a specified catalyst.

Also, U.S. Pat. No. 5,026,936 to Arco teaches a process for the preparation of propylene from $C_4$ or higher feeds by a combination of cracking and metathesis wherein the higher hydrocarbon is cracked to form ethylene and propylene and at least a portion of the ethylene is metathesized to propylene. See also, U.S. Pat. Nos. 5,026,935;5,171,921 and 5,043,522.

U. S. Pat. No. 5,069,776 teaches a process for the conversion of a hydrocarbonaceous feedstock by contacting the feedstock with a moving bed of a zeolitic catalyst comprising a zeolite with a pore diameter of 0.3 to 0.7 nm, at a temperature above about 500° C. and at a residence time less than about 10 seconds. Light olefins are produced with relatively little saturated gaseous hydrocarbons being formed. Also, U.S. Pat. No. 3,928,172 to Mobil teaches a process for converting hydrocarbonaceous feedstocks wherein light olefins are produced by reacting said feedstock in the presence of a ZSM-5 catalyst.

One problem inherent in conventional light olefin production using FCC units is that the process depends on a specific catalyst balance to maximize production of light olefins while also achieving high conversion of the 650° F. plus feed components. In addition, even if a specific catalyst balance can be maintained to maximize overall light olefin production, light olefin selectivity is generally low due to undesirable side reactions, such as extensive cracking, isomerization, aromatization and hydrogen transfer reactions. Light saturated gases produced from undesirable side reactions result in increased costs to recover the desirable light olefins. Therefore, it is desirable to maximize olefin production in a process that allows a high degree of control over the selectivity to light olefins.

Another problem associated with conventional olefin production via the cracking of higher molecular weight hydrocarbon species using zeolite catalysts is that the catalyst requires steam activation prior to use to provide sufficient conversion activity. Moreover, some conventional light olefin processes using catalyst steam activation exhibit little if any light olefin selectivity increase in connection with the activity increase. The catalyst may be activated prior to use in a light olefin conversion reaction, thereby increasing process and equipment requirements. Alternatively, it may be activated during the light olefin conversion reaction by adding steam to the feed. This method detrimentally reduces initial light olefin yield compared to steady state yield because the initial catalyst charge requires a period of time for activation. In-situ steam activation also leads to a diminished steady-state yield because fresh catalyst make-up added during the process requires a period of time for activation. There is, therefore, a need for a catalyst that does not require steam activation to selectively produce light olefins from a catalytically or thermally cracked naphtha containing paraffins and olefins.

SUMMARY OF THE INVENTION

The invention relates to a catalytic conversion process comprising:

contacting a naphtha containing olefins with a catalytically effective amount of a catalyst, wherein the catalyst contains 10 to 80 wt. % of a molecular sieve having an average pore diameter less than about 0.7 nm, under catalytic conversion conditions in order to form a product, wherein the catalyst's Steam Activation Index is greater than 0.75.

The invention also relates to a catalytic conversion process, comprising:

contacting a naphtha containing olefins with a catalytically effective amount of a molecular sieve catalyst under catalytic conversion conditions in order to form a product containing propylene, wherein (a) the molecular sieve catalyst contains 10 to 80 wt. % of a crystalline zeolite, based on the weight of the catalyst, having an average pore diameter less than about 0.7 nm;

(b) the molecular sieve catalyst contacts steam (i) at a steam pressure in a steam pressure range of from 0 atmospheres to about 5 atmospheres prior to catalytic conversion, (ii) with a steam amount in a steam amount range of from 0 mol. % to 50 mol. %, based on the amount of the naphtha, during catalytic conversion, and (iii) during a combination of (i) and (ii); and (c) the weight ratio of the propylene in the product to the naphtha changes by less than about 40% over the steam pressure range, the steam amount range, and combinations of the steam pressure range and steam amount range.

In yet another embodiment, the invention relates to a catalytic conversion process, comprising:

contacting a naphtha containing olefins with a catalytically effective amount of a molecular sieve catalyst under catalytic conversion conditions in order to form a product containing propylene, wherein the molecular sieve catalyst contains 10 to 80 wt. % of a crystalline zeolite having an average pore diameter less than about 0.7 nm, with the proviso that if the molecular sieve catalyst contacts steam (i) at a steam pressure ranging from 0 atmospheres to about 5 atmospheres prior to catalytic conversion, (ii) at a steam amount ranging from 0 mol. % to 50 mol. %, based on the amount of the naphtha, during the catalytic conversion, and (iii) during a combination of (i) and (ii), then the catalyst's catalytic activity for forming the propylene is substantially insensitive to the steam amount, the steam pressure, and combinations thereof.

In a preferred embodiment the invention is a process for selectively producing light olefins in a process unit comprised of a reaction zone, a stripping zone, and a catalyst regeneration zone. The naphtha stream is contacted in the reaction zone, which contains a bed of catalyst, preferably in the fluidized state. The catalyst is comprised of a zeolite having an average pore diameter of less than about 0.7 nm. The reaction zone is operated conventionally at a temperature from about 525° C. to about 650° C., a hydrocarbon partial pressure of 10 to 40 psia, a hydrocarbon residence time of 1 to 10 seconds, and a catalyst to feed weight ratio of about 2 to 10.

In another preferred embodiment of the present invention the molecular sieve catalyst is a zeolite catalyst, more preferably a ZSM-5 type catalyst.

In still another preferred embodiment of the present invention the feedstock contains about 10 to 30 wt. %. paraffins, and from about 20 to 70 wt. % olefins, and no more than about 20 wt. % of the paraffins are converted to light olefins.

In yet another preferred embodiment of the present invention the reaction zone is operated at a temperature from about 525° C. to about 650° C., more preferably from about 550° C. to about 600° C.

BRIEF DESCRIPTION OF THE DRAWINGS

FIG. 1 shows the effect of steam activation on conventional naphtha cracking catalyst.

DETAILED DESCRIPTION OF THE INVENTION

Figure 2A:
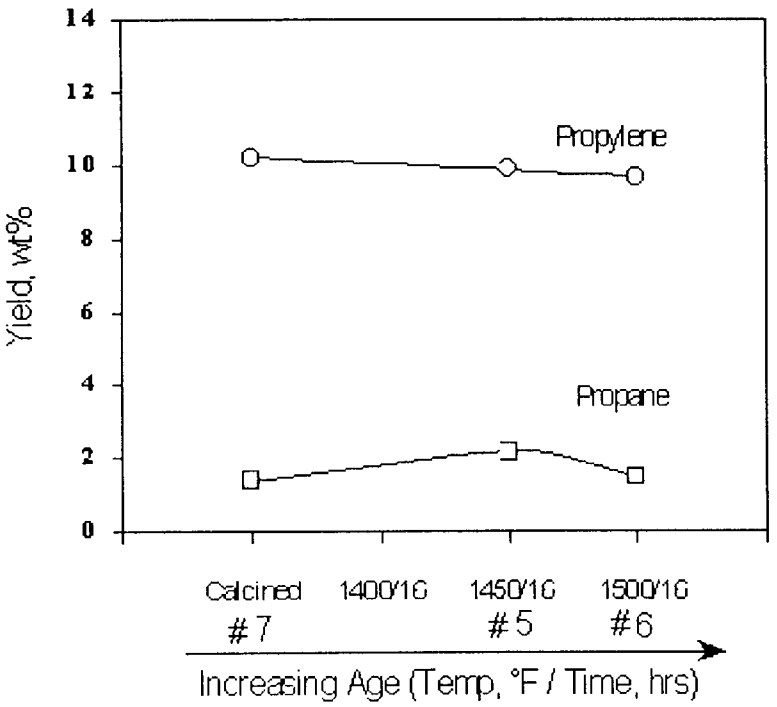
FIG. 2 shows that the preferred catalysts are about as active and selective as the treated conventional catalyst, even when the preferred catalyst is fresh.

The invention is related to processes using molecular sieve catalysts and naphtha feedstreams to selectively form light olefins. Preferred processes use zeolite-containing catalysts having 10 to 80 wt. % of a crystalline zeolite, based on the weight of the fluidized catalyst, having an average pore diameter less than about 0.7 nm. The invention is based on the discovery of catalysts useful for selective light olefin production that do not require steam activation.

In one embodiment, preferred feedstreams include those streams boiling in the naphtha range and containing from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The feed may also contain naphthenes and aromatics.

In another embodiment, preferred feedstreams boil in the naphtha range and contain greater than about 70 wt. % olefin and preferably greater than about 90 wt. % olefin.

Naphtha boiling range streams are typically those having a boiling range from about 65° F. to about 430° F., preferably from about 65° F. to about 300° F. The naphtha can be any stream predominantly boiling in the naphtha boiling range and containing olefin, for example, a thermally cracked or a catalytically cracked naphtha. Such streams can be derived from any appropriate source, for example, they can be derived from the fluid catalytic cracking ("FCC") of gas oils and resids, or they can be derived from delayed or fluid coking of resids, or from steam cracking and related processes. It is preferred that the naphtha streams used in the practice of the present invention be derived from the fluid catalytic cracking of gas oils and resids. Such naphthas are typically rich in olefins and/or diolefins and relatively lean in paraffins.

The preferred catalyst may be used in a process unit comprised of a reaction zone, a stripping zone, a catalyst regeneration zone, and a separation zone. The naphtha feedstream is conducted into the reaction zone where it contacts a source of hot, regenerated catalyst. The hot catalyst vaporizes and cracks the feed at a temperature from about 525° C. to about 650° C., preferably from about 550° C. to about 600° C. The cracking reaction deposits carbonaceous hydrocarbons, or coke, on the catalyst, thereby deactivating the catalyst. The cracked products are separated from the coked catalyst and sent to a separation zone. The coked catalyst is passed through the stripping zone where volatiles are stripped from the catalyst particles, for example, with steam. The stripping can be performed under low severity conditions in order to retain adsorbed hydrocarbons for heat balance. The stripped catalyst is then passed to the regeneration zone where it is regenerated by burning coke on the catalyst in the presence of an oxygen containing gas, for example, air. Decoking restores catalyst activity and simultaneously heats the catalyst to, e.g., about 650° C. to about 750° C. A supplemental fuel may also be required for heat balance in cases where insufficient coke is formed to provide the reactor's heat requirements. The hot catalyst is then recycled to the reaction zone to react with fresh naphtha feed. Flue gas formed by burning coke in the regenerator may be treated for removal of particulates and for conversion of carbon monoxide, after which the flue gas may be discharged into the atmosphere. The cracked products from the reaction zone are sent to a separation zone where various products may be recovered, such as a light olefin fraction.

The invention may be practiced in a conventional FCC process unit, in order to increase light olefins yields in the FCC process unit itself, under FCC conversion conditions. In another embodiment, the invention uses its own distinct process unit, as previously described, which receives naphtha from a suitable source. Preferably, the reaction zone is operated at process conditions that will maximize light olefin selectivity, particularly propylene selectivity, with relatively high conversion of $C_5$+ olefins.

Preferred molecular sieve catalysts include those that contain molecular sieve having an average pore diameter less than about 0.7 nanometers (nm), the molecular sieve comprising from about 10 wt. % to about 80 wt. %, preferably about 20 wt. % to about 60 wt. %, of the total fluidized catalyst composition.

It is preferred that the molecular sieve be selected from the family of medium pore size (<0.7 nm) crystalline aluminosilicates, otherwise referred to as zeolites. The pore diameter also sometimes referred to as effective pore diameter can be measured using standard adsorption techniques and hydrocarbonaceous compounds of known minimum kinetic diameters. See Breck, *Zeolite Molecular Sieves*, 1974 and Anderson et al., J. Catalysis 58, 114 (1979), both of which are incorporated herein by reference.

Molecular sieves that can be used in the practice of the present invention include medium pore zeolites described in "Atlas of Zeolite Structure Types," eds. W. H. Meier and D. H. Olson, Butterworth-Heineman, Third Edition, 1992, which is hereby incorporated by reference. The medium pore size zeolites generally have a pore size from about 0.5 nm, to about 0.7 nm and include for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable molecular sieves include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates.

The medium pore size zeolites can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crystalline admixtures are themselves medium pore size zeolites and are not to be confused with physical admixtures of zeolites in which distinct crystals of crystallites of different zeolites are physically present in the same catalyst composite or hydrothermal reaction mixtures.

The preferred catalysts may be held together with a catalytically inactive inorganic oxide matrix component, in accordance with conventional methods.

The preferred catalysts do not require steam contacting, treatment, activation, and the like to develop olefin conversion selectivity, activity, or combinations thereof. Preferred catalysts include OLEFINS MAX™ catalyst available from W. R. Grace and Co., Columbia, Md.

The preferred catalyst may be phosphorus-containing. The phosphorus may be added to the formed catalyst by impregnating the zeolite with a phosphorus compound in accordance with conventional procedures. Alternatively, the phosphorus compound may be added to the multicomponent mixture from which the catalyst is formed. Among phosphorus-containing, zeolite catalysts useful in the invention, phosphorus-containing ZSM-5 is most preferred.

As discussed, the preferred molecular sieve catalyst does not require steam activation for use under olefin conversion conditions to selectively form light olefins from a catalytically or thermally cracked naphtha containing paraffins and olefins. In other words, the preferred process propylene yield is substantially insensitive to whether the preferred molecular sieve catalysts contact steam prior to catalytic conversion, during catalytic conversion, or some combination thereof However, steam does not detrimentally affect such a catalyst, and steam may be present in the preferred olefin conversion process.

Steam may be and frequently is present in fluidized bed reactor processes in the feed and in regions such as the reactor zone and the regenerator zone. The steam may be added to the process for purposes such as stripping and it may naturally evolve from the process during, for example, catalyst regeneration. In a preferred embodiment, steam is present in the reaction zone. Importantly, the presence of steam in the preferred process does not affect catalyst activity or selectivity for converting feeds to light olefins to the extent observed for naphtha cracking catalysts known in the art. For the preferred catalysts, propylene yield by weight based on the weight of the naphtha feed under the preferred process conditions ("propylene yield") does not strongly depend on catalyst steam pretreatment or the presence of steam in the process. Accordingly, at least about 60 wt. % of the $C_5$+ olefins in the naphtha stream are converted to $C_4$− products and the reactor effluent's total $C_3$ product comprises at least about 90 mol. % propylene, preferably greater than about 95 mol. % propylene, whether or not (i) catalyst steam pretreatment is employed, (ii) steam is added to or evolves in the catalytic conversion process, or (iii) some combination of (i) and (ii) is employed.

Conventional molecular sieve catalyst steam activation procedures involving steam pretreatment and adding steam to a feed are set forth, for example, in U.S. Pat. No. 5, 171, 921. Conventionally, a steam pretreatment may employ 1 to 5 atmospheres of steam for 1 to 48 hours. When steam is added in conventional processes, it may be present in amounts ranging from about 1 mol. % to about 50 mol. % of the amount of hydrocarbon feed. Pretreatment is optional in the preferred process because the preferred catalyst's activity and selectivity for propylene yield is substantially insensitive to the presence of steam.

When a pretreatment is employed in the preferred process, it may be conducted with 0 to about 5 atmospheres of steam. By 0 atmospheres of steam it is meant that no steam is added in the pretreatment step. Steam resulting from, for example, water desorbed from the catalyst, associated pretreatment equipment, and combinations thereof may be present, usually in very small amounts, during pretreatment even when no steam is added. However, like added steam, this steam does not substantially affect the catalyst's activity for propylene yield. Adding steam to the preferred process as in, for example, stripping steam, a naphtha-steam feed mixture, or some combination thereof is also optional. When steam is added to the preferred process, it may be added in an amount ranging from about 0 mol. % to about 50 mol. % of the amount of hydrocarbon feed. As in the case of pretreatment, 0 mol. % steam means that no steam is added to the preferred process. Steam resulting from the preferred process itself may be present. For example, steam resulting from catalyst regeneration may be present, usually in very small amounts, during the preferred process even when no steam is added. However, such steam does not substantially affect the catalyst's activity for propylene yield.

When the preferred catalysts of this invention are steam pretreated and then employed in the preferred process, propylene yield changes by less than 40%, preferably less than 20%, and more preferably by less than 10% based on the propylene yield of the preferred process using an identical catalyst that was not pretreated. Similarly, when the preferred catalyst is used in the preferred process and steam is injected with the naphtha, propylene yield changes by less than 40%, preferably less than 20%, and more preferably by less than 10% based on the propylene yield of the preferred process using an identical catalyst where steam injection was not employed. Preferably, propylene yield ranges from about 8 wt. % to about 30 wt. %, based on the weight of the naphtha feed.

The Steam Activation Index test is one way to evaluate catalysts to determine whether they would require steam activation for use in napththa cracking. In accordance with the test:

(i) a candidate catalyst is calcined at a temperature of 1000° F. for four hours and then divided into two portions;

(ii) 9 grams of the first catalyst portion are contacted with hydrocarbon consisting of a catalytically cracked naphtha boiling in the range of $C_5$ to 250° F. and containing 35 wt. % to 50 wt. % olefins based on the weight of the naphtha in order to form a product containing propylene (The contacting is conducted in a model "R" ACE™ unit available from Xytel Corp Elk Grove Village, Illinois. The contacting in the ACE unit is conducted under catalytic conversion conditions that include a reactor temperature of 575° C., a reactor pressure differential of 0.5 psi to 1.5 psi, a feed injection time of 50 seconds and a feed injection rate of 1.2 grams per minute.) and the amount of propylene in the product is determined;

(iii) the second catalyst portion is exposed to 1 atmosphere of steam at a temperature of 1500° F. for 16 hours; and then (iv) 9 grams of the catalyst from (iii) is contacted with the same naphtha as in (ii) in the ACE unit under the same conditions as in (ii) and the amount of propylene in the product is determined; and (v) the ratio of the wt. % yield of the propylene in (ii) to the wt. % yield of the propylene in (iv) is the Steam Activation Index.

For the preferred catalysts, the Steam Activation Index is above 0.75. More preferably, such catalysts have a Steam Activation index ranging from 0.75 to about 1, and still more preferably ranging from about 0.8 to about 1, and even more preferably from 0.9 to about 1.

Preferably, the catalyst is used under catalytic conversion conditions including temperatures from about 525° C. to about 650° C., preferably from about 550° C. to about 600° C., hydrocarbon partial pressures from about 10 to 40 psia, preferably from about 15 to 25 psia; and a catalyst to naphtha (wt/wt) ratio from about 3 to 12, preferably from about 5 to 9, where catalyst weight is the total weight of the catalyst composite. As discussed, steam may be concurrently introduced with the naphtha stream into the reaction zone, with the steam comprising up to about 50 wt. % of the hydrocarbon feed, preferably up to about 20 wt. %. Also, it is preferred that the naphtha residence time in the reaction zone be less than about 10 seconds, for example from about 1 to 10 seconds, preferably from about 2 to about 6. The above conditions will be such that at least about 60 wt. % of the $C_5$+ olefins in the naphtha stream are converted to $C_4$− products. When paraffins are present in the feed, less than about 25 wt. %, preferably less than about 20 wt. % of the paraffins are converted to $C_4$− products. The reactor effluent's total $C_3$ product comprises at least about 90 mol. % propylene, preferably greater than about 95 mol. % propylene. It is also preferred that the reactor effluent's total $C_2$ products comprise at least about 90 mol. % ethylene, with the weight ratio of propylene:ethylene being greater than about 3, preferably greater than about 4. The "full range" $C_5$+ naphtha product motor and research octanes are substantially the same as or greater than in the naphtha feed.

Light olefins resulting from the preferred process may be used as feeds for processes such as oligimerization, polymerization, co-polymerization, ter-polymerization, and related processes (hereinafter "polymerization") in order to form macromolecules. Such light olefins may be polymerized both alone and in combination with other species, in accordance with polymerization methods known in the art. In some cases it may be desirable to separate, concentrate, purify, upgrade, or otherwise process the light olefins prior to polymerization. Propylene and ethylene are preferred polymerization feeds. Polypropylene and polyethylene are preferred polymerization products made therefrom.

EXAMPLES

1. Three samples of the same conventional naphtha cracking catalysts having 40 wt. % ZSM-5 content were calcined at 1000° F. for four hours and then steam activated at a steam pressure of 1 atmosphere external to the naphtha cracking reactor under conventional conditions at 1400° F. (sample 1), 1450° F. (sample 2), and 1500° F. (sample 3) for 16 hours. For comparison purposes, a fourth sample (sample 4) was not steam treated but calcined at 1000° F. for four hours. The four catalysts were employed under simulated riser reactor conditions to convert a catalytically cracked naphtha boiling in the range of $C_5$ to 430° F. and having a 22 wt. % olefin content. Conversion conditions included a reactor temperature of about 575° C. and a catalyst to naphtha (wt./wt.) ratio of about 10. As can be seen in FIG. 1-A, the three samples that were steam pretreated showed an increased activity for propylene production and a decreased activity for propane production compared with the catalyst that was not preteated (sample 4). FIG. 1-B shows that propylene selectivity also increases for the steam activated conventional catalysts.

Figure 2B:
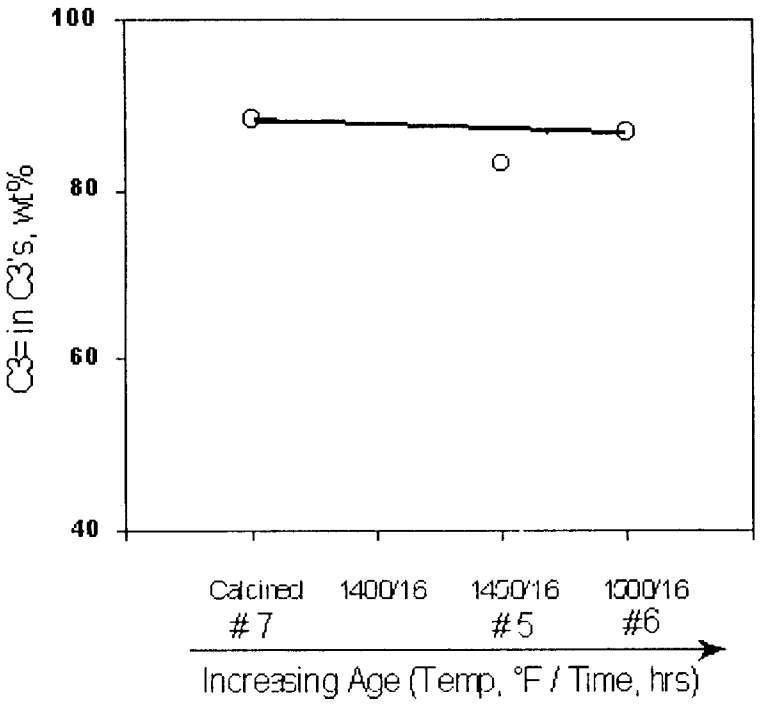

2. Preferred catalysts were examined to determine the effect of steam on propylene activity and selectivity. Three catalyst samples were prepared and calcined, all having a 25 wt. % ZSM-5 content. Sample 5 was steam pretreated at a steam pressure of 1 atmosphere at 1450° F. for 16 hours. Sample 6 was steam pretreated at a steam pressure of 1 atmosphere at 1 500° F., also for 16 hours. Sample 7 was not treated with steam but was calcined at 1000° F. for four hours. FIGS. 2-A and 2-B show that no increase in propane or propylene activity is obtained from steam treatment of the preferred catalysts under similar conditions to those in Example 1; the preferred catalyst is active for propylene production even when fresh. Moreover, the preferred catalyst when fresh has substantially the same propylene selectivity as the steam activated catalyst of Example 1. The propylene selectivity and activity of the preferred catalyst even when fresh is a very desirable feature because fluid bed systems naturally require make-up of fresh catalyst during and resulting from, for example, withdrawal and cyclone loss. When such make-up obtained from conventional catalyst, an activity and selectivity loss would be observed unless the catalyst was pretreated or contacted with steam in the reaction zone as shown in FIGS. 1-A and 1-B. This deficiency is overcome with the preferred catalyst because pretreatment or including steam in the reaction zone are not required.

3. Conventional and preferred catalysts were evaluated for effectiveness with steam present in the naphtha feed. Simulated fluidized bed reactor conditions were employed to convert a catalytically cracked naphtha boiling in the range of $C_5$ to 430° F. and having a 39 wt. % olefin content. Conversion conditions included a reactor temperature of about 630° C. and a catalyst to naphtha (wt./wt.) ratio of about 9. The percent change in propylene yield, by weight based on the weight of the feed, was determined as the amount of steam in the feed was varied.

Figure 3:
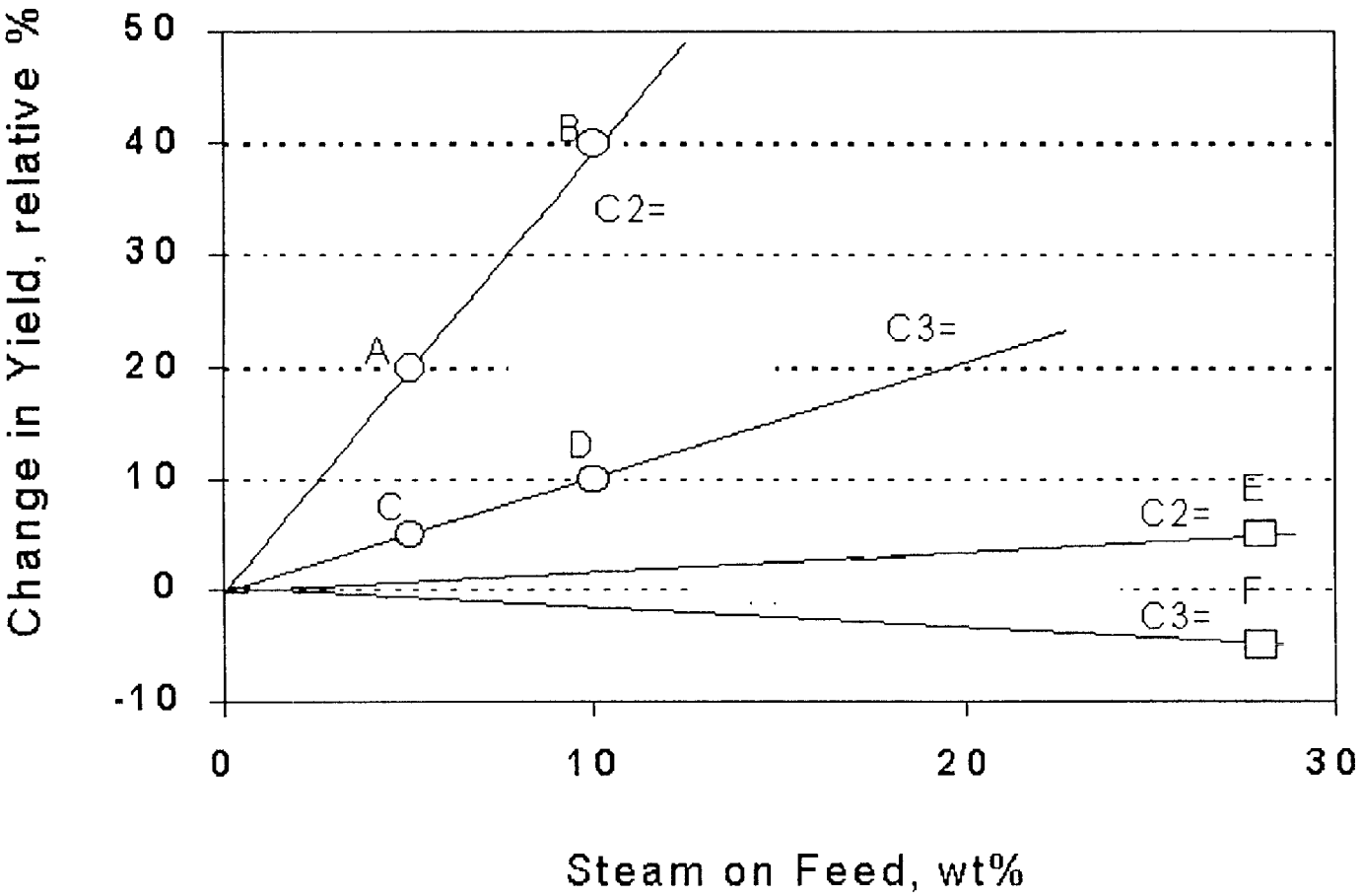
FIG. 3 shows that feeds used in connection with the preferred catalysts need not contain steam.

As can be seen in FIG. 3, the conventional catalyst having a 40 wt. % ZSM-5 content shows a substantial increase in ethylene (points A and B) and propylene (points C and D) yield change with increased steam content in the feed. This result contrasts sharply with the preferred catalyst, in this case an Olefins Max™ catalyst, which shows only a slight change in ethylene (point E) and propylene (point F) yield over a much wider range of steam concentration.

What is claimed is:

1. A catalytic conversion process comprising:

contacting a thermally or catalytically cracked naphtha, the naphtha containing about 10 to about 30 wt. % paraffins, and from about 20 to about 70 wt. % olefins, with a catalytically effective amount of a catalyst in a fluidized bed reactor, wherein the catalyst contains 20 to about 60 wt. % of a ZSM-5 molecular sieve having an average pore diameter less than about 0.7 nm, wherein the catalyst's Steam Activation Index is greater than 0.75, under catalytic conversion conditions including a temperature of about 525° C. to about 650° C., a hydrocarbon partial pressure of about 10 to about 40 psia, a hydrocarbon residence time of about 1 to about 10 seconds, and a catalyst to naphtha weight ratio of about 2 to about 10, in order to form a product having a weight ratio of propylene to ethylene which is greater than about 3, with no more than about 20 wt. % of the paraffins being converted to light olefins, further provided that i) the naphtha contains $C_5$+ olefins, and at least about 60 wt. % of the $C_5$+ olefins in the naphtha are converted to species having a molecular weight lower than $C_4$, ii) less than 25 wt. % of the paraffins in the naphtha are converted to species having a molecular weight lower than $C_4$, iii) the product contains a $C_3$ fraction with propylene comprising at least about 90 mol. % of the $C_3$ fraction, and iv) the product contains a $C_2$ fraction with ethylene comprising at least about 90 mol. % of the $C_2$ fraction.

2. The process of claim 1 wherein the catalyst contains about 40 wt. % of the ZSM-5.

3. The process of claim 1 wherein the catalyst's Steam Activation Index ranges from greater than 0.75 to about 1.

4. The process of claim 3 wherein the catalyst's Steam Activation Index ranges from about 0.8 to about 1.

5. The process of claim 4 wherein the catalyst's Steam Activation Index ranges from 0.9 to about 1.

6. The process of claim 1 further comprising separating the propylene from the product and then polymerizing the propylene in order to form polypropylene.

* * * * *